United States Patent [19]

Hayden

[11] 4,321,098

[45] Mar. 23, 1982

[54] CONTINUOUS HARDENING OF HIGH SPEED STEEL

[76] Inventor: Howard A. Hayden, 2318 Dorchester, Troy, Mich. 48084

[21] Appl. No.: 138,677

[22] Filed: Apr. 9, 1980

Related U.S. Application Data

[63] Continuation of Ser. No. 1,429, Jan. 8, 1979, abandoned.

[51] Int. Cl.[3] ..... C21D 9/52

[52] U.S. Cl. ..... 148/14; 148/16; 148/16.7; 148/131

[58] Field of Search ..... 148/131, 143, 14, 16, 148/16.7

[56] References Cited

U.S. PATENT DOCUMENTS 3,469,829 9/1969 Fujita et al. ..... 148/131

*Primary Examiner*—R. Dean

*Attorney, Agent, or Firm*—Harness, Dickey & Pierce

[57] ABSTRACT

A wire of high speed steel is hardened and straightened by a continuous method wherein an annealed high speed steel wire is subjected to steps of austenitizing; quenching; tempering and cooling; and then tempering and cooling under tension. The hardened and straightened high speed steel wire can be cut, centerless ground and fluted to make hardened, straight, high speed steel twist drills.

13 Claims, 3 Drawing Figures

CONTINUOUS HARDENING OF HIGH SPEED STEEL

This is a continuation of application Ser. No. 1,429, filed Jan. 8, 1979, abandoned.

BACKGROUND OF THE INVENTION

The present invention relates to a process for continuously hardening and simultaneously straightening wire made of high speed steel. High speed steel wire which has been treated in accordance with the present invention is particularly useful in making high speed twist drills.

High speed twist drills are made of high speed steel and must be straight. Unfortunately, it is difficult to manufacture such drills to the desired rectilinearity. Long drills of small diameter, such as aircraft extension drills, are particularly difficult to manufacture straight but cannot be used accurately if bowed or warped beyond a minimal degree. Conventional manufacturing processes can produce drills of satisfactory straightness. However, conventional processes employ several straightening operations for the purpose of correcting unwanted bends in the drill. Such straighting operations are time consuming and expensive, and it would be highly desirable if they could be minimized.

Accordingly, it is an object of the present invention to provide a high speed steel wire which is substantially straight to reduce the time and expense required by additional straightening operations. Another object of this invention is to provide a continuous method which is an economical and practical method of hardening and straightening wire of high speed steel. Still another object of this invention is to provide a method of providing high speed steel wire particularly useful in making drills. These and other objects, features, and advantages of the present invention will be apparent from the following disclosure and claims taken in conjunction with the accompanying drawing.

DESCRIPTION OF THE INVENTION

Figure 1:
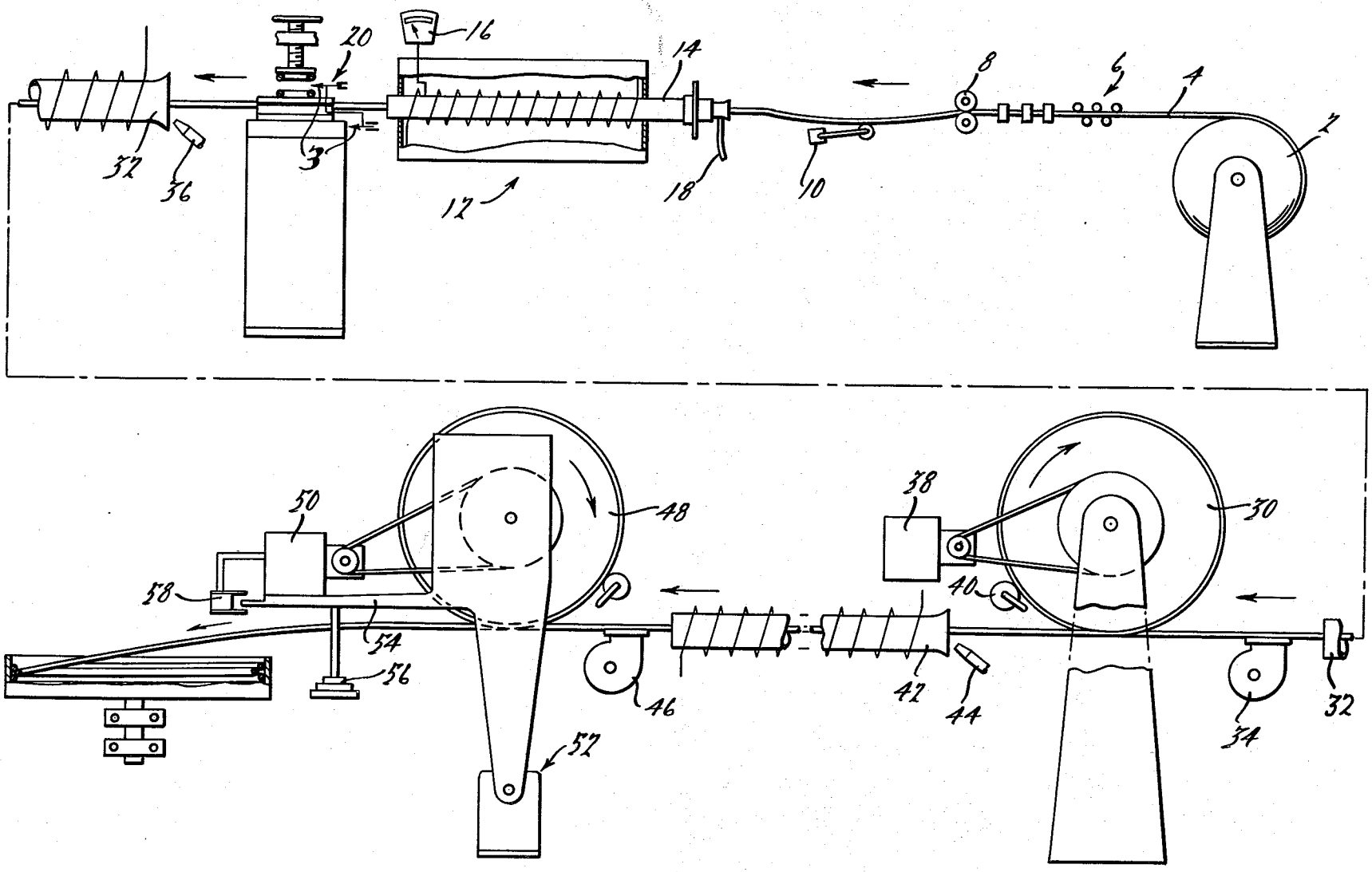
FIG. 1 is a schematic diagram illustrating the preferred steps of the continuous method of the present invention.

In accordance with the present invention, high speed steel wire is hardened and straightened by a continuous process wherein a wire is sequentially subjected to steps of: austenitizing; quenching; tempering and cooling; and then tempering and cooling while simultaneously applying a longitudinal tensioning force to the wire.

In general, annealed high speed steel is heat treated by austenitizing, quenching and tempering steps to obtain a martensite crystal structure which offers the combination of hardness, wear resistance, toughness, shock resistance and high temperature hardness which is characteristic of high speed steel. It has been found, however, that in the case of high speed steel wire, an unwanted effect of conventional austenitizing, quenching and tempering steps is to impart unbalanced internal stresses to the wire which cause a bending or warping thereof. It is believed that such stresses occur during the transformation of the wire from an austenitic crystal form to a martensitic crystal form. In a process wherein the wire is austenitized, quenched to room temperature, and then subjected to two tempering/cooling steps, as in the present invention, about 80% of the austenite is converted to martensite during the first quenching step and then about 80% of the residual austenite is converted to martensite during each of the two subsequent tempering/cooling steps so that the final product comprises less than 1% austenite. Unfortunately, the conversion of austenite to martensite tends to generate internal stresses in the internal structure of the steel, because the crystal form of martensite is more voluminous than is that of austenite. These stresses are, of course, not equally balanced about the longitudinal axis of the wire and tend to bend or warp the wire as the unbalanced forces are accommodated by the wire.

In accordance with the present invention it has been found that the internal stresses generated during the conversion of austenite to martensite can be accommodated in a manner alternative to warping or bending of the wire by exerting a tension force along the longitudinal axis during a second tempering/cooling step when the last substantial portion of austenite is transformed to martensite. The result is a hardened high speed steel wire of improved straightness which is suitable for use in making high speed drills with little or no additional straightening required.

By the term high speed steel is meant a medium carbon, high alloy steel such as M-1, M-2, or M-7 steel. An example of high speed steel contemplated for use in the present invention is a steel having a carbon content of about 0.85% and an alloy content of about 5% molybdenum, 6% tungsten, 4% chromium, and 2% vanadium. High speed steel is characterized by high hardness, wear resistance, toughness, shock resistance, and high temperature hardness after being heat treated to a tempered martensitic crystal structure. The starting material of the present method is annealed, high speed steel in the ferritic condition.

Figure 2:
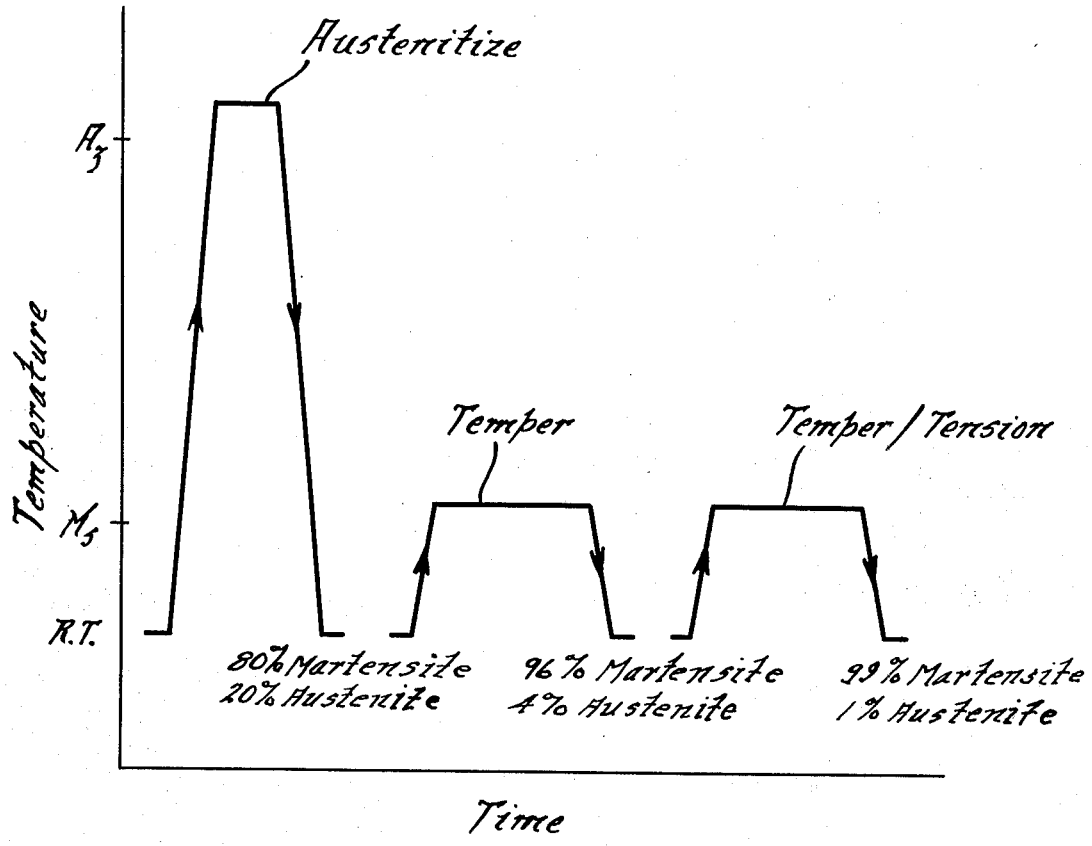
FIG. 2 is a diagram graphically illustrating the time and temperature relationship in the steps of the method of the present invention.

It will be appreciated that the method of this invention contemplates a continuous process offering advantages of economy and efficiency and, hence, it is intended that a wire portion will be subjected to sequential steps in accordance with the present method as the wire is transported continuously, for example, from a supply reel to a take-up reel or drum. Thus, as indicated in FIG. 2, the first step of this invention is austenitizing a high speed steel wire portion. The austenitizing step is conventionally carried out by heating the wire portion in an inert atmosphere to a temperature above the austenitizing temperature, conventionally desingated $A_3$, and holding the wire portion at that temperature for a time sufficient to transform the crystal structure therein from ferritic to austenitic form. The exact time and temperature required is, of course, dependent on the particular steel composition and will be readily determinable by those skilled in the art. The wire at this high temperature has little tensile strength and care must be taken to avoid tensile forces in transporting the wire which would cause undue stretching or breaking of the wire.

After the austenitizing step, the austenitized wire is subjected to a quenching step. Although this quenching step can be carried out in a conventional manner, preferably the wire is quenched by means of a pair of aligned carbide dies, each of which has a groove of semi-circular cross-section. The longitudinal axis of each groove is parallel to the longitudinal axis of the wire and is adapted to align with the groove in the other die of the pair to form a bore through which the wire is pulled simultaneously to quench and impart an initial straightness to the wire. By this means the austenitized wire is quenched to about room temperature and approximately 80% of the austenite is converted to martensite.

In accordance with the present invention, the wire portion is then subjected to a first tempering step followed by a first cooling step. The tempering step can be conventionally carried out by heating the wire in an inert atmosphere to above the temperature conventionally designated $M_s$, which tempers the previously formed martensite. The exact tempering time and temperature depend upon the composition of the high speed steel wire and is readily determinably by one skilled in the art. The cooling step can be carried out by blowing cooling air over the wire portion to draw heat therefrom and lower its temperature to about room temperature. These steps convert about 80% of the residual austenite to martensite.

Next, the wire portion is subjected to a second tempering step followed by a second cooling step, both of which can be carried out in the same manner as the first tempering and cooling steps but with the additional provision of tensioning along the longitudinal axis of the wire. About 80% of the still remaining austenite is transformed to martensite during these steps. During the second tempering and cooling steps, the wire is subjected simultaneously to an applied tensioning force which apparently effects an alignment of the crystal structure as the residual austenite largely converts to martensite, leaving less than 1% residual austenite in the steel. While the required tensioning force is believed to be most effective during the cooling step, it is also advantageously employed during the tempering step. Although the exact effect of the tension on the crystal structure is not known, the resulting wire tends to be straighter than wire not subjected to the tensioning force. A sufficient amount of tensile force must be applied to obtain the desired straightening effect without exerting so much force that the wire is unduly stretched or broken. Care must be taken so that the force is not applied in a manner which will cause flattening of the wire. The tensioning force should be at least 10,000 lbs. per sq. in., for example, 50,000 lbs. per sq. in. (of cross sectional area) has been found suitable. Following the second tempering and quenching steps, the wire portion is collected for storage or immediate use. If the wire is recoiled, care must be taken to see that the wire is not stressed beyond its elastic limit to thereby impart a curvature thereto.

It has been found that high speed steel wire hardened and straightened in accordance with the above method is particularly suitable to be cut into desired lengths and subjected to centerless grinding and flute grinding steps to make high speed drills. While the stresses imparted to the wire during these subsequent steps may warp the wire, or now drill, enough to require a straightening operation, it has been found that the time and effort involved to produce a straight drill has been reduced because of the reduction in warpage characteristic of earlier processes.

Application of the method of this invention to annealed M-2 wire of about 1/16 of an inch in diameter is illustrated as FIG. 1. Thus, a stock coil 2 provides a continuous feed of soft wire to straightener rolls 6 which remove any curvature of wire 4 learned while in the stock coil 2. Wire 4 is transported from stock coil 2 and through straightener 6 by means of pull rolls 8, the rotating speed of which is controlled by motor control 10. In general, motor control 10 adjusts the speed of pull rolls 8 to equal the speed at which wire 4 is transported through austenitizing furnace 12. It will be appreciated that wire straightener rolls 6 serve the purpose of imparting sufficient straightness to wire 4 so that wire 4 can be fed through austenitizing furnace 12 without contacting an inward facing surface thereof and that if wire 4 is sufficiently straight to allow passage through furnace 12, straightener rolls 6 are not necessary.

Austenitizing furnace 12 generally comprises an electrically heated tube 14 about three feet in length and one inch in diameter, suitable temperature control means 16 and nitrogen gas inlet means 18 to provide an inert atmosphere in the interior thereof to prevent damage to the surface of wire 4 during the austenitizing step. The interior of tube 14 has a temperature of about 2300° F. and wire 4 is transported therethrough at a speed such that a wire portion will be subjected to the heated atmosphere for about three minutes.

Figure 3:
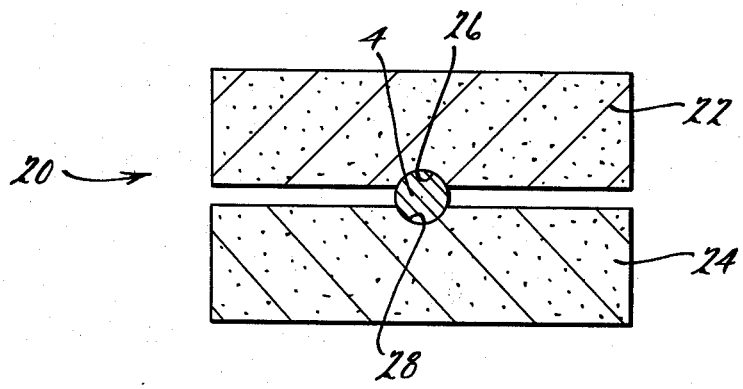
FIG. 3 is a sectional view taken along lines 3—3 of FIG. 1 of a pair of carbide dies employed in the present invention.

After passing through furnace 12, wire 4 is immediately quenched to room temperature and simultaneously straightened by passing between a pair of aligned carbide dies 20. As shown in FIG. 3, carbide dies 20 include a first die 22 and a second die 24, each having longitudinally extending facing grooves 26 and 28 of semi-circular cross section and about 6 inches of length. Grooves 26 and 28 cooperate to guidably receive and straighten wire 4 while simultaneously drawing heat therefrom. Passing wire 4 through carbide dies 20 effectively removes heat from wire 4 to near room temperature and gives wire 4 an initial straightness. Grooves 26 and 28 are applied to wire 4 with pressure and a pulling force must be applied to wire 4 to overcome the resulting friction. This pulling force is exerted by a large capstan roller 30 which overcomes the friction and pulls wire 4 not only through dies 20 but also through first tempering furnace 32 and past cooling means 34, which is an air blower effective to lower the temperature of the wire to room temperature. First tempering furnace 32 is an electrically heated tube furnace of about 12 feet in length and 2 inches in diameter and has an interior temperature of about 1000° F. As in austenitizing furnace 12, an inert atmosphere is provided within tempering furnace 32 by injecting nitrogen therein through nitrogen inlet means 36.

Capstan roller 30 is about 4 feet in diameter and is driven by a controllable motor drive 38 which is conventionally controlled to transport wire 4 at about 12 inches per minute. An additional roller 40 can be employed to facilitate control of transport wire 4 to ensure that no slack is permitted upstream of capstan roller 30. Wire 4 is wrapped around capstan 30 three times to obtain a capstan effect so that tension applied to wire 4 downstream of capstan 30 is not transmitted upstream of capstan 30. The diameter of capstan 30 must be sufficiently great to obtain a capstan effect with a reasonable number of turns of wire thereon.

Wire 4 is taken off capstan 30 and transported downstream through second tempering furnace 42 which is identical to first tempering furnace 32 having an inert atmosphere inlet means 44 and an interior temperature of 1000° F. Downstream of second tempering furnace 42, wire 4 is cooled by air blower 46 and then wound onto second capstan 48 which is about 4 feet in diameter. Wire 4 is wrapped around capstan 48 three times to obtain a capstan effect and capstan 48 is driven by drive motor 50 at a rate slightly greater than capstan 30, i.e. at 12.001 inches per minute if capstan 30 is driven at 12.000 inches per minute, thereby to exert a stretching or tensioning force of about 50,000 lbs. per square inch on the portion of wire 4 between capstan 30 and 48. The required speed control of capstan 48 can be obtained by pivotally mounting capstan 48 with associated drive means 50 on a pivot 52 to provide a moment arm 54, the exact weight of which can be adjusted by means of weights 56 attached thereto, and providing switch means 58 which adjustably controls the rate of capstan 48 to maintain moment arm 54 in a selected position thereby maintaining a selected tension on wire 4 between capstans 48 and 30.

Downstream of capstan 48, wire 4, now hardened and straightened, is fed into a coiling tub 60 which is of large enough diameter to avoid bending wire 4 beyond its elastic limit. Coiling tub 60 is, of course, only one means which could be used to collect wire 4 downstream of capstan 48. For example, wire 4 could be stored on large rolls or taken off capstan 48 and cut to length for immediate further processing.

Of course, it is evident that those skilled in the art, once given the benefit of the foregoing disclosure, may now make modifications of the specific embodiment disclosed herein without departing from the spirit of the present invention. Such modifications are to be considered within the scope of this invention which is limited solely by the scope and spirit of the appended claims.

What is claimed is:

1. A method of continuously hardening and straightening high speed steel wire comprising sequentially subjecting an annealed high speed steel wire portion to steps of: austenitizing and quenching; first tempering and first cooling; second tempering and second cooling, said second tempering and second cooling being carried out while simultaneously applying a tensioning force of at least 10,000 lbs. per square inch to said wire portion.

2. The method recited in claim 1 wherein said first quenching is carried out by pulling said wire portion between a pair of aligned carbide dies having elongated grooves therein.

3. The method recited in claim 2 wherein said tensioning force is applied by tensioning said wire portion between a pair of capstans.

4. The method recited in claim 3 wherein said first tempering and said second tempering are carried out in electrically-heated tube furnaces.

5. The method recited in claim 4 wherein said austenitizing, first tempering and second tempering are carried out in an inert atmosphere.

6. The method recited in claim 5 wherein said inert atmosphere is a nitrogen atmosphere.

7. The method recited in claim 6 wherein said first cooling and said second cooling are carried out by means of air blowers.

8. The method recited in claim 7 wherein said wire portion is passed between soft wire straightening rollers prior to said austenitizing.

9. A method of hardening wire made of annealed high speed steel in a ferritic state comprising the following steps: Austenitizing said steel to transform substantially all of said steel to austenite; quenching said steel to transform about 80% of said steel to martensite; tempering and cooling said steel to transform about 80% of the remaining austenite therein to martensite; and then tempering and cooling said steel to transform about 80% of the still remaining austenite therein to martensite while simultaneously applying a tensioning force of at least 10,000 lbs. per square inch along the longitudinal axis of said steel.

10. The method recited in claim 9 wherein said tensioning force is applied by stretching said steel between a pair of capstans.

11. The method recited in claim 10 wherein said quenching is carried out by pulling said steel between a pair of carbide dies having longitudinally aligned grooves therein.

12. The method recited in claim 11 wherein said austenitizing and said tempering steps are carried out in an inert atmosphere.

13. The method recited in claim 12 wherein both of said cooling steps are carried out by means of an air blower.

* * * * *